US007302975B2

(12) United States Patent
Wegman

(10) Patent No.: US 7,302,975 B2
(45) Date of Patent: Dec. 4, 2007

(54) METHOD AND SYSTEM FOR INCREASING DENSITY OF TONER IN A TONER CONTAINER

(75) Inventor: Paul M. Wegman, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 219 days.

(21) Appl. No.: 11/068,316

(22) Filed: Feb. 28, 2005

(65) Prior Publication Data

US 2006/0191590 A1 Aug. 31, 2006

(51) Int. Cl.
*B65B 1/20* (2006.01)

(52) U.S. Cl. ..... 141/80; 141/8; 141/65; 141/73; 141/325

(58) Field of Classification Search ..... 141/8, 141/12, 59, 65, 69, 71, 73, 80, 325, 326; 220/371; 399/106; 53/405
See application file for complete search history.

(56) References Cited

U.S. PATENT DOCUMENTS 2,381,454 A * 8/1945 Huth ..... 141/59
4,967,814 A * 11/1990 Day, Jr. ..... 141/286
4,976,296 A * 12/1990 Pope ..... 141/46
5,434,654 A 7/1995 Nagai
5,576,816 A 11/1996 Staudt et al.
5,711,353 A * 1/1998 Ichikawa et al. ..... 141/67
5,740,506 A 4/1998 Sundquist et al.
5,749,401 A * 5/1998 Shinya et al. ..... 141/80
5,758,231 A 5/1998 Coffey et al.
5,809,744 A 9/1998 Villines et al.
5,988,234 A 11/1999 Wegman
6,024,141 A 2/2000 Wegman
6,315,011 B1 11/2001 Smith
6,347,648 B1 2/2002 Wegman et al.
6,679,301 B2 * 1/2004 Makino et al. ..... 141/67
6,722,406 B2 4/2004 Wegman et al.

* cited by examiner

*Primary Examiner*—Timothy L. Maust
(74) *Attorney, Agent, or Firm*—Maginot, Moore & Beck

(57) ABSTRACT

A system and method enable toner to be packed more densely in a toner container and the container to be more quickly filled with toner. The system includes a container for storage of toner in an xerographic reproduction machine, the container having a fill opening, and a porous plug in a wall of the container; a filling system for mating to the fill opening of the container to provide toner to the container; and a source of negative pressure coupled to the porous plug to remove air from an internal volume of the container and more densely pack the toner stored in the container.

19 Claims, 2 Drawing Sheets

METHOD AND SYSTEM FOR INCREASING DENSITY OF TONER IN A TONER CONTAINER

TECHNICAL FIELD

The present invention relates generally to the filling of toner storage containers, and more particularly, to filling toner storage containers having air permeable openings to evacuate air during the filling of toner into the container.

BACKGROUND

Toner is the term used to generally describe the particulate material that is applied and fused to paper by an electrographic or xerographic reproduction system to reproduce text and images. The toner is typically stored in a container or cartridge housed within the electrographic reproduction system. The cartridge or container may have a body with an internal volume within which the toner is stored. Prior to installation in an electrographic reproduction system, the toner cartridge or container must be filled with toner particulate matter.

The process for filling a toner container with toner currently requires that the toner be transported from a toner supply hopper into the container by a rotating auger. The auger is a spiral shaped mechanical part which pushes particles of toner inside a fill tube by direct mechanical contact. The nature of this mechanical contact process creates substantial limitations on the accuracy, efficiency, and speed of the toner container filling operation. The speed of the toner movement in the fill tube is proportional to the speed of rotation of the auger and is limited by the heat produced by friction occurring between the auger and toner. High auger speed causes the toner to melt, particularly for low melt toner, such as the one disclosed in U.S. Pat. No. 5,227,460 to Mahabadi et al. the relevant portions thereof are herein expressly incorporated by reference.

To more effectively and efficiently fill toner containers, the rotating augers used to transport the toner from hoppers are relatively large. The large augers provide for high volume toner flow and thus improve productivity in a fill line. When utilizing such fill lines for small, low cost copiers and printers, fill problems occur because the openings in the toner containers for small copiers and printers are small and may have an irregular shape. Furthermore, the openings may be located at a position on the container that is not centrally located on the container. As a consequence, smaller filling tubes and augers are required to fit the small toner container fill openings. Efficiency for filling toner containers housed in small copiers and printers is important because these devices produce copies in higher quantities, which requires that the containers be filled with as much toner as possible.

Problems with efficient toner filling are also apparent in small and medium cost multi-colored highlight or full color printers and copiers. The toner containers for color toner typically are smaller than those for black toner and also more typically have an irregular shape. Also, color toners have been developed with smaller particle size of, for example, 7 microns or less. The smaller particles of the colored toners do not flow as easily through toner hoppers as larger particles and are not easily translated from the hopper by the augers.

The problems associated with controlling the filling of toner containers are due primarily to the properties of the toner. There are two different types of developing systems known as one component and two-component systems. In one-component developing systems, the developer material is toner made of particles of magnetic material, such as iron, that are embedded in a black plastic resin. The iron enables the toner to be magnetically charged. In two- component systems, the developer material is comprised of toner which consists of small polymer or resin particles, a color agent, and a carrier which consists of roughly spherical particles or beads usually made of steel. An electrostatic charge between toner particles and carrier beads causes toner particles to cling to carrier beads in the development process. Control of the flow of these small, abrasive and easily charged particles is very difficult.

The toner particles used in one-component and two-component systems do not flow easily and they tend to cake and bridge within the supply hopper. This limits the flow of toner through the small tubes that are required for supplying the smaller openings in toner containers for small copiers and printers. Also, this tendency to cake and bridge may cause air gaps to form in the container resulting in partial filling of the container. Attempts to improve the flow of toner have also included the use of an external vibrating device to loosen the toner within the hopper. These vibrators are energy intensive, costly, but they do not necessarily produce consistently effective filling of the toner containers. Furthermore, they tend to cause the toner to cloud causing dirt to accumulate around the filling operation.

Difficulties have also occurred in efforts to start and stop quickly the flow of toner from the hopper during high speed production operations. An electromagnetic toner valve has been developed as described in U.S. Pat. Nos. 5,839,485 and 5,685,348, both of which issued to Wegman et al. and they issued on Nov. 24, 1998 and Nov. 11, 1997, respectively. Both of these patents are assigned to the same assignee as this application and the disclosures thereof are hereby expressly incorporated herein by reference in their entireties. The electromagnetic valve is limited for use with toner that can be magnetized such as that described for use with one component development systems.

Attempts have been made to fill toner containers having small toner fill openings by utilizing adapters positioned on the end of the toner filling auger that has an inlet corresponding to the size of the auger and an outlet corresponding to the opening in the toner container. Clogging with toner, particularly when attempting to increase toner flow rates and when utilizing toners with smaller particle size, for example, color toners having a particle size of 7 microns or less, has been found to be a perplexing problem. The adapters that are fitted to the augers, thus, tend to clog with toner. The flow rates through such adapters are unacceptably low. Further, the use of these adapters may create problems with maintaining a clean atmosphere free of toner at the site of the filling operation.

The following disclosures relate to various aspects of toner container filling systems and the problems encountered with filling toner containers with toner particles: U.S. Pat. No. 5,531,253 to Nishiyama et al. that issued on Jul. 2, 1996, U.S. Pat. No. 5,839,485 to Wegman et al. that issued on Nov. 24, 1998, U.S. Pat. No. 5,685,348 to Wegman et al. that issued on Nov. 11, 1997, U.S. Pat. No. 5,947,169 to Wegman et al that issued on Sep. 7, 1999, and U.S. Pat. No. 5,909,829 to Wegman et al that issued on Jun. 8, 1999. Portions of the foregoing disclosures may be briefly summarized as follows:

U.S. Pat. No. 5,531,253 discloses a cleaner for cleaning the nozzle portion of a powder filling apparatus by equally evacuating the inside and the outside of the container and dropping powder through the nozzle portion into the container simultaneously with the raising the pressure outside the container.

U.S. Pat. No. 5,838,485, entitled "Electromagnetic Valve and Demagnetizing Circuit" discloses a method and apparatus for filling a container with a magnetic material using an electromagnetic valve and a demagnetizing circuit to control the flow and properties of the material. In the filling process, the auger located inside of the fill tube rotates and moves the material through the fill tube. When the container is filled, the auger stops rotating and the electromagnetic valve actuated. The electromagnetic valve supplies a magnetic field which holds the material in place, plugging the fill tube with the material as the filled container is removed and replaced with a new container to be filled. When the electromagnetic valve is switched off, a demagnetizing circuit is activated. After the material is demagnetized, the auger is switched on and the material flows again into the container.

U.S. Pat. No. 5,685,348 discloses a method and apparatus for filling a container with toner using a series of traveling magnetic fields to control the flow of toner from a supply of toner to the container. Initially, an empty container is placed under a fill tube through which toner is supplied to the container. In the filling process the traveling magnetic fields, which are supplied by turning on and off a series of solenoids, and gravity cause toner from the toner supply to move through the fill tube. When a solenoid is turned on toner particles are attracted to its magnetic field where a plug of toner is formed. The solenoids are controlled so that a discrete amount of toner is supplied in each on/off cycle of the solenoids. The solenoid on/off cycle is repeated until the container is filled with toner. When the container is filled, the appropriate solenoid is activated so that a plug of toner stops the flow of toner in the fill tube. The filled container is removed from the fill tube and an empty container is put in its place so that the solenoid on/off cycle may begin again.

U.S. Pat. No. 5,947,169 entitled "Oscillating Valve for Powders" discloses a method for filling a powder container. The method includes the steps of placing a first powder container to be filled in filling relationship to a discharge feature in the vessel, directing the powder in the vessel toward a member located at least partially within the vessel, the member defining a restriction therein such that the powder clogs within the restriction, mechanically exciting the powder at least adjacent the restriction to improve the flow properties of the powder so as to unclog the powder within the restriction, dispensing powder through the restriction, through the discharge feature and into the first container, stopping the mechanical excitation of the powder so as to clog the restriction with the powder, removing the first container from the vessel, and placing a second container to be filled in filling relationship to the vessel.

U.S. Pat. No. 5,909,829 entitled "Vibratory Filler for Powders" discloses a method for filling a powder container. The method includes the steps of placing a first powder container to be filled in filling relationship to a supply of powder in a vessel, mechanically exciting the powder in the vessel to improve its flow properties, dispensing powder from the vessel into the first container, removing the first container from the vessel, and placing a second container to be filled in filling relationship to the vessel.

All of the above-referenced patents are hereby expressly incorporated by reference herein in their entireties.

While the problems regarding toner flow have been addressed by the solutions set forth in these patents, they do not address the efficient use of the internal volume in the container. As toner flows into a container, air is pushed out of the container. The fit between the filling tube and the filling opening typically enables air to flow out of the container during a filling operation without interfering with the flow of toner particles into the container. However, replacement of the air in the container with toner particles is not completely efficient. That is, air becomes trapped between toner particles and this air reduces the amount of toner that is stored in the container. If this air were removed from the internal volume of the container, more toner could be stored in the container.

SUMMARY

The present invention addresses the need for more efficiently storing toner in a container, as well as others, by providing a system for more densely packing toner into a container during a toner filling operation. The system comprises a container for storage of toner in a xerographic reproduction machine, the container having a fill opening and a porous plug extending through a wall of the container; a filling system for mating to the fill opening of the container to provide toner to the container; and a source of negative pressure coupled to the porous plug to remove air from an internal volume of the container and more densely pack the toner stored in the container. By coupling a negative pressure source, such as a vacuum, to the porous plug, the toner replaces the air more quickly and the spacing between toner particles is reduced.

The porous plug may be installed in an end wall or a side wall of the container. The porous plug may be comprised of sintered polypropylene, sintered polyethylene, or the like. The porous plug may be installed in the container wall opening so that the plug is detachable from the opening. In one embodiment, the plug may be detached from the opening when the container is installed in a xerographic reproduction machine by an auger that delivers toner from the container to the development station. Preferably, the porous plug extends from the container wall through which it extends into the internal volume of the container. A longer porous plug extends the effect of the negative pressure in the internal volume so that denser packing of the toner particles does not occur solely at the wall of the container. The porous plug, however, may be flush with the wall in which it is mounted or extend to any length up to the longitudinal length of the container. A porous plug extending approximately 20-50% into the inner volume of the container has been found to pack more densely toner particles in a substantial portion of the toner container.

In one embodiment of the present invention, the negative pressure source draws a vacuum of approximately 30 inches of water. The magnitude of the negative pressure source, however, depends upon the dimensions of the container, the shape of the container, the properties of the toner stored in the container, and the rate at which air is to be removed from the internal volume of the container. Negative pressure sources drawing from one inch to fifty inches of water are able to pack toner particles more densely into toner containers.

A method for densely packing toner in a container for placement in an xerographic reproduction system comprises providing toner to a fill opening of a container for storage of the toner in the container; and applying a source of negative pressure to an porous plug of the container to remove air from an internal volume of the container and more densely pack the toner stored in the container.

A container for storing toner in an xerographic reproductions system comprises a body having an internal volume for storing toner therein, a fill opening in the body for providing toner to the internal volume of the container for storage, and a porous plug mounted in the body of the container so that a source of negative pressure coupled to the porous plug can remove air from the internal volume of the container and more densely pack the toner stored in the container.

The above described features and advantages, as well as others, will become more readily apparent to those of ordinary skill in the art by reference to the following detailed description and accompanying drawings.

DETAILED DESCRIPTION

Figure 1:
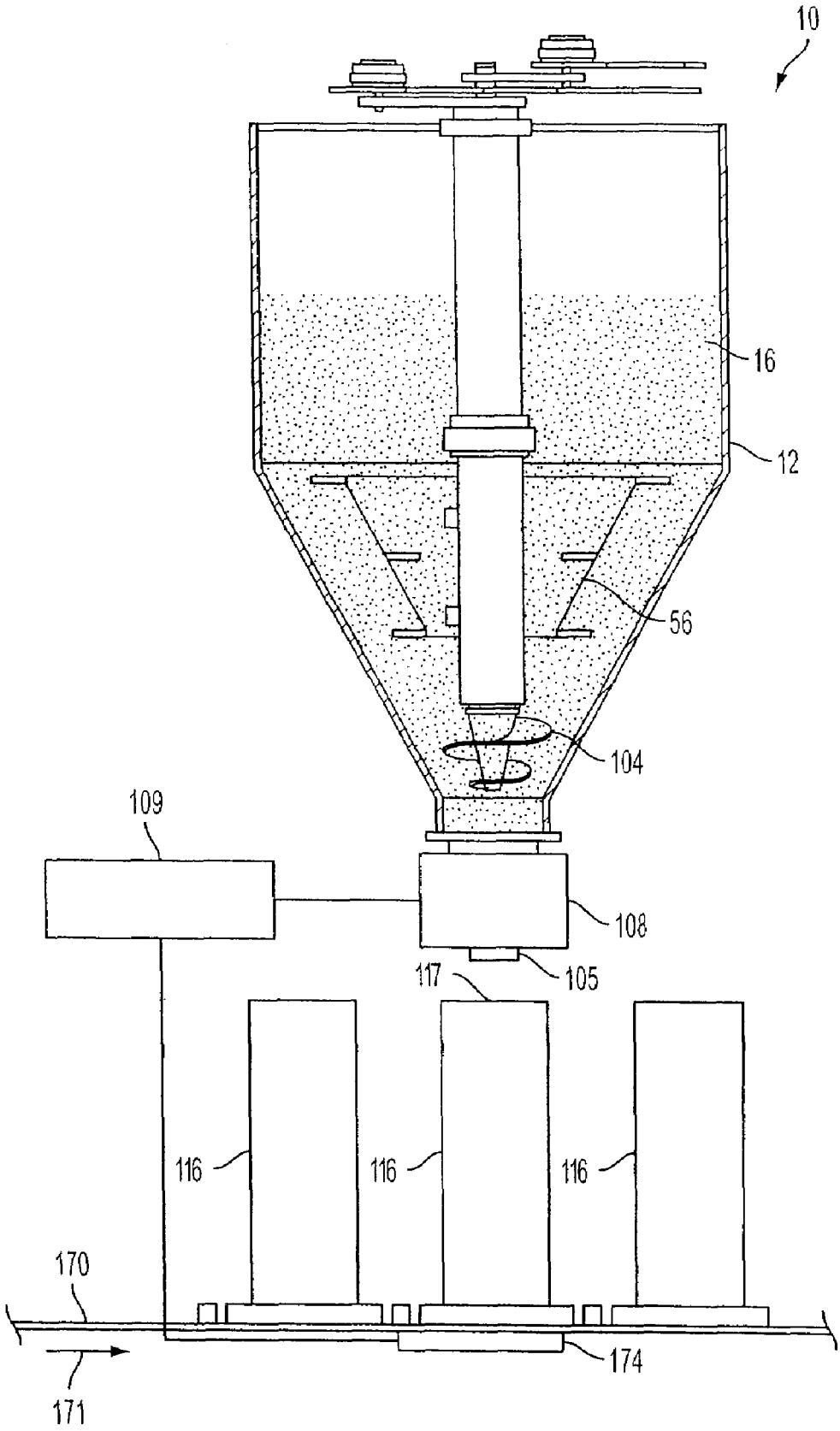
FIG. 1 shows a system for filing toner containers with toner.

FIG. 1 shows a system 10 for filling toner storage containers with toner. A hopper 12 having a supply of toner 16 is connected to a fill tube 105. The hopper 12 may be made of any suitable, durable material that is chemically non-reactive with the toner, for example, stainless steel. An auger 104 is vertically disposed within the hopper 12 for moving toner 16 to the discharge end of the fill tube 105. Coupled to the outside of the fill tube 105 is a valve 108, that may be an electromechanical or electromagnetic valve to start and stop the flow of toner from the discharge end of the fill tube 105. The valve 108 is activated and deactivated by the controller 109.

A high speed production line may be provided below the hopper 12 and the fill tube 105. A conveyor 170 has a plurality of carriers 172, called pucks, mounted on it. Each puck 172 has a toner container 116 in it and the conveyor transports the containers 116 in the direction of arrow 171. The pucks 172 are specially designed and built for each type of toner container with a puck allowing for different container widths and heights. Of course, containers may be placed on a conveyor without pucks, particularly if the filling line is a dedicated line and the container has a self-supporting shape that stabilizes the container as it moves on the conveyor 170. When a puck and container are in position under the fill tube 105, a lifting mechanism 174 pushes the puck 172 and the container 116 up until the lift mechanism 174 is fully extended and the fill opening 117 of the container 116 is in proximity to the discharge end of the fill tube 105.

The controller 109 energizes an agitator 56 to cause toner to migrate towards the auger 104 so it is transported by the auger into the fill tube 105. The controller also activates the valve 108 so that toner may be pushed from the fill tube 105 into the fill opening 117 of the container 116. When the container 116 is filled, the controller deactivates the valve 108 to stop the flow of toner to the fill tube and the lift mechanism 174 lowers the puck 172 and the container 116 to the conveyor 170. The conveyor then moves the filled container from the fill position and the next empty container is moved to the fill position. The amount of toner loaded in the container is predetermined based on the size of the container and the flow of toner is enabled for period of time that permits the container 116 to be filled with the predetermined amount. While the filling process has been described with reference to a system in which the toner container is lifted for filling, alternative systems may be used that lower the fill tube 105 for container filling. Another alternative is to keep the containers and the fill tube vertically stable with the container fill opening being sufficiently close to the fill tube at the fill position that toner dispensed from the fill tube 105 falls through the container opening 117.

To facilitate the filling of the toner containers, the controller 109 may also control a negative pressure source, such as a vacuum, that is coupled to an porous plug of the container 116. Alternatively, a vacuum source may remain energized and be selectively coupled to an opening in the puck 172 so that negative pressure is placed at an porous plug mounted in the bottom of the container 116. The negative pressure source pulls air from the internal volume of the container 116 as the toner enters the container 116. The resulting vacuum in the container 116 aids in pulling toner into the container 116 and in packing the toner in the container more densely.

Figure 2:
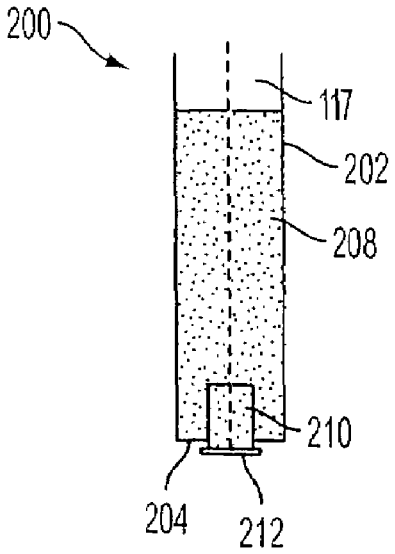
FIG. 2 shows a porous plug having a porous plug that extends into the internal volume of a toner container.

A toner cartridge 200 to which a negative pressure source may be coupled is shown in FIG. 2. The container 200 includes a body having a side wall 202 and an end wall 204 that define an internal volume 208 for the storage of toner. Mounted, by press fitting or the like, in the end wall 204 is a porous plug 210. A secondary foam seal 212 may also be included at the opening of the container wall. The inclusion of foam seals in toner containers is well-known. The porous plug 210 may be made so that it is flush with the inside of the end wall 204 or so it extends into the internal volume 208 as shown in FIG. 2. Although the plug 210 is shown as being mounted in the end wall 204, it may be alternatively mounted in the side wall 202. The porous plug may be comprised of a number of materials that do not clog with toner particles that are 7 microns or less in diameter. Such materials include sintered polypropylene and sintered polyethylene. Sintered metals may also be used for plug 210, although the costs of such plugs may be prohibitive.

The porous plug 210 may extend from the wall in which it is mounted up to approximately 100% of the longitudinal length of the container. For most applications, a porous plug extending approximately 20-50% into the inner volume of the container when the plug is mounted in the end wall 204 is adequate. When the plug is mounted in the side wall 202, the plug may be flush with the side wall or extend from the side wall 202 at any length up to approximately 100% of the width of the container into the internal volume 208. The plug may be mounted in the side wall proximate the end wall 204 or it may be located anywhere along the length of the sidewall, however, placement in the side wall between the midpoint of the sidewall and the end wall 204 is preferred. The extension of the plug into the internal volume is effective for more densely packing most of the toner in the container.

The porous plug 210 may be permanently mounted in the wall of a toner container or it may be detachably mounted in the wall. In a detachable mounting, the porous plug 210 may be mounted in a toner discharge port for the container 200. When the container 200 is installed in a xerographic reproduction machine, an auger that delivers toner from the container 200 to a development station in the machine is pushed into the discharge port and the porous plug 210 is detached. The detached plug 210 remains within the internal volume of the container 200.

Figure 3:
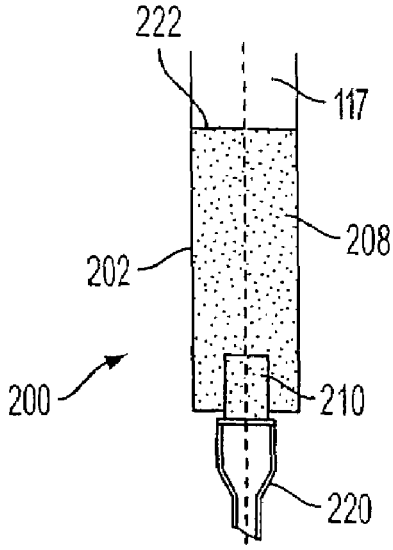
FIG. 3 shows a negative pressure source being applied to the porous plug of a toner container to pack the toner more densely into the container.

A negative pressure source 220 may be coupled to the porous plug 210 as shown in FIG. 3. As the toner fills the container, the negative pressure source removes air from the internal volume 208. The toner immediately adjacent the plug 210 is more densely packed than the remaining toner because the more densely packed toner attenuates the pull of air flow through the container. This is demonstrated in the figure by the lower fill line 222 for the toner in FIG. 3. In order to extend the removal of air from areas of the container further within the internal volume 208 of the container 200, the plug 210 extends from the wall in which it is mounted, as shown in FIGS. 2 and 3. To facilitate the filling of the container 200, the negative pressure source is coupled to the porous plug 210 while the container 200 is being filled. If fill time is not an issue, the container 200 may be filled first and then a negative pressure source coupled to the porous plug 210 to pack the toner more densely into the container. A negative pressure source that works well with such a porous plug 210 may draw from approximately one inch of water to approximately fifty inches of water. A negative pressure source of approximately 30 inches of water is preferred for most toner containers.

Figure 4:
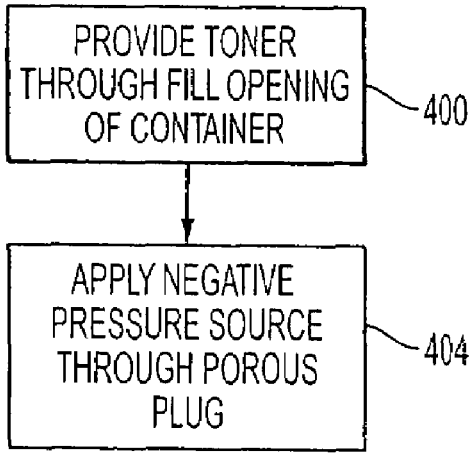
FIG. 4 shows a method for filling a toner container using a negative pressure source.

A method for densely packing toner in a container for placement in an xerographic reproduction system is shown in FIG. 4. The method comprises providing toner through a fill opening of a container for storage of the toner in the container (block 400) and applying a source of negative pressure to an porous plug of the container to remove air from an internal volume of the container and more densely pack the toner stored in the container (block 404). In this method, the porous layer of the air permeable cover of the porous plug stops toner flow from the container while enabling air to be evacuated from the internal volume of the container. A foam seal may be placed across the opening in which the porous plug is mounted.

In operation, a porous plug is mounted in a wall of a toner container so the porous plug is part of the container as it is processed in the fill operation. Preferably, the porous plug includes a porous plug that extends into the internal volume of the container and a foam seal or other porous layer that lies across the path of an air flow exiting the porous plug. When the container is in position to be filled with toner, a negative pressure source is coupled to the porous plug so that air is removed from the internal volume of the container as toner is entering the fill opening of the container. In this manner, air is removed from the internal volume so the toner is more quickly loaded into the container and more densely packed in the container. When the container is full, the negative pressure source is decoupled from the container and the container is removed from the filling position for further processing. Thus, the system and method described above more quickly and more densely pack toner into toner containers.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for increasing the density of toner stored in a toner container comprising:

a container for storage of toner in an xerographic reproduction machine, the container having a body that defines an internal volume and a fill opening in the container body, and a porous plug mounted in another opening in a wall of the container body;

the porous plug having a first end, which is mounted in the other opening, and a second end, which is located within the internal volume of the container for storage of toner, the porous plug extending from the first end to the second end a distance that is at least approximately 20% of a distance between the wall of the container in which the other opening is located and a position on an opposing wall defining the internal volume, the porous plug remaining within the internal volume of the container throughout operational use of the container in a xerographic reproduction machine;

a filling system for mating to the fill opening of the container to provide toner through the fill opening for storage within the internal volume of the container; and a source of negative pressure coupled to the porous plug to remove air from the internal volume of the container and more densely pack the toner stored in the container.

2. The system of claim 1 wherein the other opening in which the porous plug is mounted is located in a side wall of the container body, and the second end of the porous plug is located at a position from the first end that is at least 20% of the container width.

3. The system of claim 1 wherein the other opening in which the porous plug is mounted is located in an end wall of the container body, and the second end of the porous plug is located at a position from the first end that is at least 20% of the container length.

4. The system of claim 3 wherein the porous plug extends from the first end to the second end a distance that is between approximately 20% to approximately 50% of the longitudinal length of the container.

5. The system of claim 2 wherein the porous plug extends from the first end to the second end a distance that is approximately 50% of the width of the container into the internal volume of the container.

6. The system of claim 1 wherein the porous plug is comprised of sintered polypropylene or sintered polyethylene.

7. The system of claim 1 wherein the porous plug is permanently mounted in the opening of the container.

8. The system of claim 1 wherein the porous plug is comprised of sintered metal.

9. The system of claim 1, the other opening in which the first end of the porous plug is mounted is a discharge port for the container and the porous plug is detachably mounted to the discharge port to enable the porous plug to be detached from the discharge port and remain within the internal volume of the container as toner is discharged through the opened discharge port.

10. A method for densely packing toner in a container for placement in a xerographic reproduction system comprising:

providing toner through a fill opening in a wall of a container for storage of the toner in the container;

applying a source of negative pressure to a porous plug mounted in another opening in a wall of the container to remove air from an internal volume of the container and more densely pack the toner stored in the container, the porous plug extending into the internal volume by a distance that is at least 20 percent of one of a length and width of the container and the porous plug remaining stationary in the wall of the container as the container is filled, and processing the container for toner storage while the porous plug remains mounted within the internal volume of the container.

11. The method of claim 10 further comprising:

lifting a puck on which the container rests to place the fill opening near a fill tube to receive the toner discharged from the fill tube.

12. The method of claim 11, the application of the negative pressure source further comprising:

applying the negative pressure source to an opening in the puck so negative pressure is applied to the porous plug, the opening in which the porous plug is mounted is located in a bottom wall of the container resting on the puck.

13. The method of claim 10 wherein a negative pressure of approximately 30 inches of water is applied to the porous plug mounted in the other opening of the container.

14. A container for storing toner in a xerographic reproduction system comprising:

a body having an internal volume for storing toner therein;

a fill opening in the body for providing toner to the internal volume of the container for storage;

a porous plug mounted in another opening of the body of the container, the porous plug having a first end, which is mounted in the other opening, and a second end, which is located within the internal volume of the container for storage of toner, the porous plug extending from the first end to the second end a distance that is at least approximately 20% of one of a length and width of the container; and the porous plug being configured to remain mounted within the other opening while a source of negative pressure is applied to the porous plug to remove air from the internal volume of the container body and more densely pack the toner stored in the internal volume of the container, and the porous plug remaining mounted in the other opening after the negative pressure is removed.

15. The container of claim 14 wherein the other opening in which the porous plug is mounted is located in a side wall of the body, and the second end of the porous plug is located at a position from the first end that is at least 20% of the container width.

16. The container of claim 14 wherein the other opening in which the porous plug is mounted is located in an end wall of the body, and the second end of the porous plug is located at a position from the first end that is at least 20% of the container length.

17. The container of claim 16 wherein the porous plug extends from the other opening in the container body approximately 20% of the longitudinal length of the body into the internal volume of the body.

18. The container of claim 15 wherein the porous plug extends from the other opening in the container body approximately 50% of the width of the internal volume of the container.

19. The container of claim 14 wherein the porous plug is comprised of a material selected from the group of sintered polyethylene, sintered polypropylene, and sintered metal.

* * * * *